US006893510B2

(12) United States Patent
Fortunati et al.

(10) Patent No.: US 6,893,510 B2
(45) Date of Patent: May 17, 2005

(54) PROCESS FOR THE PRODUCTION OF GRAIN ORIENTED ELECTRICAL STEEL STRIPS

(75) Inventors: Stefano Fortunati, Rome (IT); Stefano Cicale', Rome (IT); Claudia Rocchi, Rome (IT); Giuseppe Abbruzzese, Rome (IT)

(73) Assignee: Thyssenkrupp Acciai Speciali Terni S.p.A., Terni (IT)

( * ) Notice: Subject to any disclaimer, the term of this patent is extended or adjusted under 35 U.S.C. 154(b) by 0 days.

(21) Appl. No.: 10/450,968

(22) PCT Filed: Dec. 17, 2001

(86) PCT No.: PCT/EP01/14879

§ 371 (c)(1),
(2), (4) Date: Nov. 13, 2003

(87) PCT Pub. No.: WO02/50314

PCT Pub. Date: Jun. 27, 2002

(65) Prior Publication Data

US 2004/0069377 A1 Apr. 15, 2004

(30) Foreign Application Priority Data

Dec. 18, 2000 (IT) ..... RM2000A0672

(51) Int. Cl.[7] ..... H01F 1/14
(52) U.S. Cl. ..... 148/111; 148/120
(58) Field of Search ..... 148/110–113, 120–122

(56) References Cited

U.S. PATENT DOCUMENTS 6,432,222 B2 * 8/2002 Ohata et al. ..... 148/111

FOREIGN PATENT DOCUMENTS

| | | |
|---|---|---|
| EP | 0326912 | 8/1989 |
| EP | 0390160 | 10/1990 |
| EP | 0947597 | 10/1999 |
| WO | WO 98/41659 | 9/1998 |
| WO | WO 98/41660 | 9/1998 |

* cited by examiner

*Primary Examiner*—John P. Sheehan
(74) *Attorney, Agent, or Firm*—McCormick, Paulding & Huber LLP

(57) ABSTRACT

Process for the production of oriented grain electrical steel strips, in which a silicon steel, comprising at least 30 ppm of S, is directly cast as strip 1.5–4.5 mm thick and cold rolled to a final thickness of between 1.0 and 0.15 mm; characterised by the following staged: Cooling and deformation of the solidified strip to obtain a second phases distribution in which 600 $cm^{-1}$<Iz<1500 $cm^{-1}$ and Iy=1.9 Fv/r ($cm^{-1}$), Fv being the volume fraction of second phases stable at temperatures of less than 800° C., and r being the precipitates mean radius, in cm; Hot rolling between solidification and coiling of the strip at a temperature of not less than 750° C., with a reduction ratio of between 15 and 60%; Cold rolling with reduction ratio of 60–92%; Cold rolled strip annealing at 750–1100° C., with increase of the nitrogen content of at least 30 ppm with respect to the initial composition at the strip core, in nitriding atmosphere.

6 Claims, 1 Drawing Sheet

PROCESS FOR THE PRODUCTION OF GRAIN ORIENTED ELECTRICAL STEEL STRIPS

CROSS-REFERENCE TO RELATED APPLICATIONS

This application is entitled to the benefit of and incorporates by reference in their entireties essential subject matter disclosed in International Application No. PCT/EP01/14879 filed on Dec. 17, 2001 and Italian Patent Application No. RM2000A000672 filed on Dec. 18, 2000.

FIELD OF THE INVENTION

The present invention refers to a process for the production of grain oriented electrical steel strips and, more precisely, refers to a process in which a strip directly obtained from continuous casting of liquid steel is cold rolled, and in which strip precipitation of a controlled precipitation of second phases particles has been induced, said second phases being intended to control the grain growth after the primary recrystallization (primary inhibitors). In a further step, during the continuous annealing of the cold rolled strip, a further precipitation of second phases particles is induced throughout the whole thickness of the strip, having the function, along with the primary inhibitors, to control the oriented secondary recrystallization, through which a texture is obtained favourable to the magnetic flux along the rolling direction.

BACKGROUND OF THE INVENTION

Grain oriented electrical steel strips (Fe—Si) are typically industrially produced as strips having a thickness comprised between 0.18 and 0.50 mm and are characterised by magnetic properties variable according to the specific product class. Said classification substantially refers to the specific power losses of the strip subjected to given electromagnetic work conditions (e.g. $P^{50\,Hz}$ at 1.7 Tesla, in W/kg), evaluated along a specific reference direction (rolling direction). The main utilisation of said strips is the production of transformer cores. Good magnetic properties (strongly anisotropic) are obtained controlling the final crystalline structure of the strips to obtain all, or almost all, the grains oriented to have their easiest magnetisation direction (the <001> axis) aligned in the most perfect way with the rolling direction. In practice, final products are obtained having the grains mean diameter generally comprised between 1 and 20 mm having an orientation centred around the Goss orientation ({110} <001>). The minor the angular dispersion around the Goss one, the better the product magnetic permeability and hence the lesser the magnetic losses. The final products having low magnetic losses (core loss s) and high permeability have interesting advantages in terms of design, dimensions and yield of the transformers.

The first industrial production of the above materials was described by the U.S. Firm ARMCO at the beginning of the thirties (U.S. Pat. No. 1,956,559). As well known to the experts, many important improvements have been since introduced in the production technology of grain oriented electrical strips, in terms both of magnetic and physical quality of products and of transformation costs and cycles rationalisation. All existing technologies exploit the same metallurgical strategy to obtain a very strong Goss structure in the final products, i.e. the process of oriented secondary recrystallisation guided by uniformly distributed second phases and/or segregating elements. The, non metallic, second phases and the segregating elements play a fundamental role in controlling (slowing down) the movement of grain boundaries during the final annealing which actuates the selective secondary recrystallisation process.

In the original ARMCO technology, utilising MnS as inhibitor of the grain boundaries movement, and in the subsequent technology developed by NSC, in which the inhibitors are mainly aluminium nitrides (AlN+MnS) (EP 8.385, EP 17.830, EP 202.339), a very important binding step common to both production processes is the heating of the continuously cast slabs (ingots, in old times), immediately before the hot rolling, at very high temperatures (around 1400° C.) for a time sufficient to guarantee a complete dissolution of sulphides and/or nitrides coarsely precipitated during the slab cooling after casting, to re-precipitate them in a very fine and uniformly distributed form throughout the metallic matrix of the hot rolled strips. According to said known technique, such a fine re-precipitation can be started and completed, as well as the precipitates dimensions adjusted, during the process, in any case, however, before the cold rolling. The slab heating to said temperatures requires using special furnaces (pushing furnaces, liquid-slag walking-beam furnaces, induction furnaces) due to the ductility at high temperatures of the Fe-3% Si alloys and to formation of liquid slags.

Recently, new casting technologies were developed for the liquid steel, to simplify the production processes to make them more compact and flexible and to reduce costs. An innovative technology advantageously utilised in the production of electrical steels strips for transformers is the "thin slab" casting, consisting in the continuous casting of slabs having the typical thickness of conventional already roughened slabs, apt to a direct hot rolling, through a sequence of slabs continuous casting, treating in continuous tunnel-furnaces to rise/maintain the temperature of slabs, and finishing-rolling down to coiled strip. The problems connected to the utilisation of said technique for grain oriented products mainly consist in the difficulty to maintain and control the high temperatures necessary to keep in solution the elements forming the second phases, which have to be finely precipitated at the beginning of the finishing hot-rolling step, if desired best micro-structural and magnetic characteristics are to be obtained in the end-products.

The casting technique potentially offering the highest rationalisation level of the processes and the higher production flexibility is the one consisting in the direct production of strips from the liquid steel (Strip Casting), totally eliminating the hot rolling step. Strip Casting is well known and is utilised in the production of electrical strips, in general, and more precisely of grain oriented electrical strips.

The inventors believe that, for an industrial product, it is not convenient to adopt the strategy of directly producing the grain growth inhibitors necessary to the control of the oriented secondary recrystallisation by means of precipitation induced by rapid cooling of the cast strip, as proposed in the current scientific literature and patents. This opinion derives by the fact, well known to the experts, the level of necessary inhibition (drag force to the grain boundaries movement) is high and must remain comprised within a restricted field (1800–2500 $cm^{-1}$; in other words, with an inhibition level too low or too high the quality of the end products is impaired. Moreover, the inhibition have to be very evenly distributed through the metallic matrix, in that the local lack of necessary levels of inhibition produces texture defects which critically impair the quality of the end products. This is particularly true if very high quality products (e.g. having B800>1900 mT) have to be produced.

SUMMARY OF THE INVENTION

Present invention solves the above problems through an industrial process for the production of grain oriented electrical steel strips having high magnetic characteristics including the direct continuous casting of strip (strip casting) in which the formation of the inhibitors distribution necessary to control the oriented secondary recrystallisation is obtained only after the cold rolling step of the cast strip.

Another object of present invention is to obtain a controlled quantity of inhibitors uniformly distributed throughout the matrix so as to drastically reduce the microstructure sensitivity (slowing-down of the grain boundaries movement) to the process parameters in order to permit an industrially stable process.

Still another object of present invention is a steel composition apt to the direct casting of the steel comprising a minimum quantity (>30 ppm) of sulphur and/or nitrogen in the liquid steel. Said composition advantageously further comprises: Al, V, B, Nb, Ti, Mn, Mo, Cr, Ni, Co, Cu, Zr, Ta, W, and possibly Sb, P, Se, Bi, which as micro-alloying elements tend to improve the omogeneity level of the microstructure.

Further objects will be evident from the following detailed description of the invention.

BRIEF DESCRIPTION OF THE DRAWINGS

The final quality of the products obtained according to Example 1 are shown in the enclosed drawing table, in which.

DETAILED DESCRIPTION OF THE INVENTION

Figure 1:
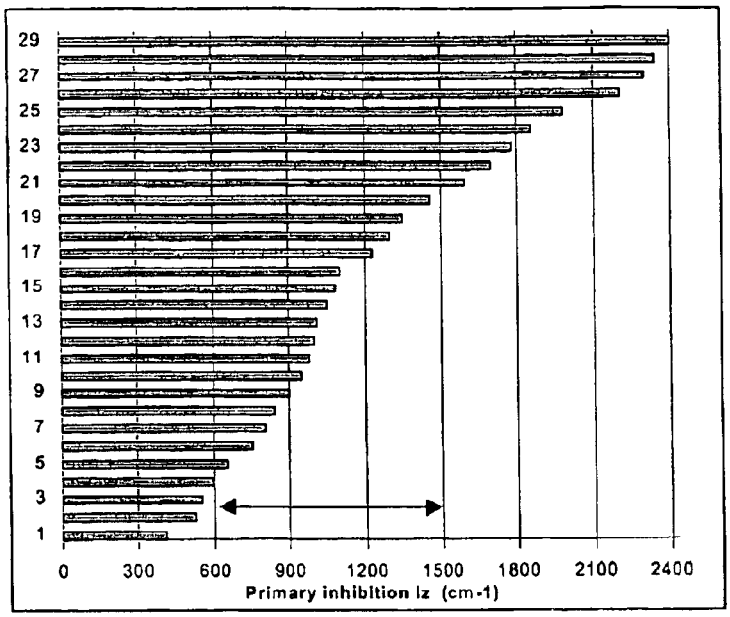
FIG. 1 shows the results of permeability measurements obtained with reference with 29 different strips, as a function of the measured Primary Inhibition.

According to the invention, it is convenient to control the inhibitors content (distribution of second phases), present in the strip prior to the cold rolling, at intensity values lower than those necessary to the control of the secondary recrystallisation in order to maintain at an uniform level the recrystallisation structure after rolling of the strip, to guarantee a constant behaviour of the microstructure to the thermal treatment in all the points of the strip itself.

Hence, it is important to induce a homogeneous distribution of inhibitors between the casting step and the cold rolling one. This allows a greater freedom in choosing the industrial treatment conditions for the continuous annealing of the cold rolled strip in terms both of control of the process parameters and of temperatures to be utilised.

In fact, if there is absence or low quantity of grain growth inhibitors in the metal matrix, or a non-homogeneous distribution thereof, any even small fluctuation of annealing parametres (such as strip speed, strip thickness, local temperature) induces a high frequency of quality defects due to the microstructural irregularity, very sensible to the thermal treatment conditions. On the contrary, a controlled amount of inhibitors uniformly distributed in the matrix, greatly reduces the sensibility of the microstructure to the process parametres (slowing-down of grain boundaries), thus permitting an industrially stable process.

There is not a metallurgical limit to the inhibition maximum level in the strip prior to the rolling. From the practical point of view, however, the inventors studying various test conditions such as the alloy composition modification, the cooling conditions and so on, did recognise that it is not convenient, for an industrial process, to have inhibition levels higher than 1500 $cm^{-1}$, for the same reasons for which it is not convenient to have, at this stage, the whole inhibition amount necessary for the secondary recrystallisation control (higher than 1500 $cm^{-1}$). Going above said inhibition levels it is necessary to greatly reduce the dimensions of the precipitates, and from the process control point of view, the produced inhibition level is very sensible to even small fluctuations of the casting and treatment conditions. In fact, the nature of the inhibitors effect with reference to the grain boundaries movement is proportional to the surface of the second phases present in the matrix. This surface is directly proportional to the volume fraction of said second phases and inversely proportional to their dimensions. It can be demonstrated that the volume fraction of the precipitates, with the same alloy composition, depends from the temperature with reference to their solubility in the metal matrix, in that the higher the treatment temperature, the minor is the volume fraction of second phases present in the matrix. In a similar way, the particle dimensions are directly related to the treatment temperature. In fact, in a particle distribution as the temperature rises the smaller particles tend to dissolve into the matrix to be reprecipitated on the bigger ones, increasing their dimensions, diminishing their total surface (a process known as dissolution and growth). Said two phenomena, well known to the experts, control the level of the drag force of a second phases distribution within a thermal treatment. As the temperature rises, also rises the speed at which the inhibition reduces its strength, depending on the exponential relationship between the temperature and the phenomena of dissolution and diffusion.

On the basis of many experiments starting from the direct continuous casting of silicon steel strips, in which were measured through electron microscopy the inhibition levels, expressed as:

$$Iz=1.9\ Fv/r\ (cm^{-1})$$

In which Fv is the volume fraction of non metallic second phases stable at temperatures lesser than 800° C., and r is the mean radius of the same precipitates, expressed in cm, present inventors did found that the better results are obtained in the interval:

$$600\ cm^{-1}<Iz<1500\ cm^{-1}$$

It was demonstrated that below 600 $cm^{-1}$ the primary recrystallisation structure is exceedingly sensible to the process fluctuations, with particular reference to temperature and strip thickness, while for values above 1500 $cm^{-1}$ it is very difficult to ensure a constant behaviour throughout the strip profile.

Said inhibition interval (for primary inhibition) is necessary for the precipitation of second phases required for the control of the oriented secondary recrystallisation (secondary inhibition) according to present invention.

Present inventors did found that, to obtain a fine and homogeneously distributed precipitation of second phases particles apt to control, along with the inhibitors already present in the matrix, the selective secondary recrystallisation process, it is convenient to let an element, apt to react with micro-alloying elements thus precipitating second phases, to permeate by means of solid phase diffusion the strip having the desired final thickness. Nitrogen was found to be the most convenient element, in that it forms sufficiently stable nitrides and carbonitrides, it is an interstitial element thus being very mobile within the metallic matrix, and particularly much more mobile than the elements to which it react to form nitrides. The above characteristic allows, adopting the opportune treatment conditions, to homogeneously precipitate the required nitrides throughout the strip thickness.

The technique utilised to generate a nitriding atmosphere during the strip annealing is not important. However, to guarantee that the nitrogen diffusion front forms the desired inhibition for the control of the oriented secondary recrystallisation, it is necessary the presence in the metal matrix of evenly distributed micro-alloying elements forming nitrides stable at high temperature. Very convenient from the industrial point of view is the utilisation of $NH_3+H_2+H_2O$ mixtures permitting to easily modulate the amount of nitrogen diffused into the steel strip by contemporary controlling the nitriding power, proportional to the $pNH_3/pH_2$ ratio, as well as the oxidising potential, proportional to the $pH_2O/pH_2$ratio.

The nitriding temperature according to present invention cannot be below 800° C. In fact, at lower nitriding temperatures the nitrogen reaction with silicon (typically present in amounts between 3 and 4 wt %) prevails forming silicon nitrides and blocking nitrogen at the strip surface, preventing its penetration towards the strip core and hence the formation of a homogeneous distribution of inhibitors. throughout the strip thickness. The higher the silicon content in the matrix, the higher will have to be the nitriding temperature.

There is no upper limit to the nitriding temperature, the choice of the best temperature being determined by the balance between the desired nitride distribution and the process exigencies.

In the absence, in the metal matrix, of a given minimal and controlled distribution of second phase particles (as primary inhibition) according to present invention, the capability to nitride at high temperature is limited in view of the risk to generate temperature-activated local and undesired evolutions of the micro-structure, with consequent development of eterogeneities and defects of final quality. On the contrary, the presence within the above mentioned interval of a given level of primary inhibition before the nitriding treatment ensures the micro-structural stability even at high process temperatures.

To obtain such a precipitation of second phases in the strip, in addition to the presence in the liquid steel of sulphur and/or nitrogen in limited quantities, however higher than 30 ppm, present inventors identified in the group consisting of Al, V, B, Nb, Ti, Mn, Mo, Cr, Ni, Co, Cu, Zr, Ta, W, the elements and mixtures thereof which, when present in the chemical composition of the steel, usefully participate to formation of the inhibition. Analogously, the presence of at least one of the elements Sn, Sb, P, Se, Bi, as micro-alloying additions, tend to improve the homogeneity level of the microstructure.

The control of the primary inhibitors distribution and the level of the deriving drag force are obtained, according to present invention, balancing the control elements of the following process steps, (i) the concentration of the micro-alloying elements and (ii) a controlled in-line deformation of the cast strip before its coiling within an interval of defined thickness reduction conditions.

More particularly, present inventors found, on the basis of many laboratory and industrial tests with strip-casting plants, that below a reduction ratio of 15%, unwanted conditions of non-homogeneous precipitation can occur in the rolled strip matrix, perhaps because of not controlled thermal gradients as well as of irregular deformation patterns, tending to localise in certain zones of the strip the conditions for the preferential nucleation of the second phases particles. It was also defined an upper deformation limit of 60%, in that above this limit no differences in the distribution of precipitates are found, with the addition of technological troubles, due to difficulties in controlling of the sequence casting-rolling-coiling of the strip.

The inhibitors control, moreover, cannot be obtained if the thickness reduction temperature is lesser than 750° C., in that the spontaneous precipitation due to the cooling before rolling becomes predominant thus preventing the rolling conditions to significantly control the inhibition.

The present invention, however, does not utilise the measure of the inhibition content as a factor to directly control on-line the process. More particularly, the present invention claims a process for the production of grain oriented electrical steel strips in which a silicon steel, comprising at least 30 ppm of sulphur and/or nitrogen, and at least an element of the group consisting in Al, V, Nb, B, Ti, Mn, Mo, Cr, Ni, Co, Cu, Zr, Ta, W, at least an element of the group consisting in Sn, Sb, P, Se, Bi, ti continuously cast directly in the form of a strip with a thickness comprised between 1.5 and 4.5 mm, and cold rolled to a final thickness comprised between 1.00 and 0.15 mm, said cold rolled strip being then continuously annealed for primary recrystallisation, if necessary in an oxydising atmosphere to decarburise the strip and/or to carry out a controlled surface oxidisation thereof, followed by a secondary recrystallisation annealing at temperatures higher than those of the primary recrystallisation. The process is characterised in that along the production cycle the following group of steps is sequentially carried out:

cooling cycle of the as solidified strip comprising a step of deformation at controlled temperature, so as to obtain in the metal matrix a homogeneous distribution of non-metallic second phases able to inhibit the grain boundaries movement with a drag force specifically comprised in the interval $$600\ cm^{-1} < Iz < 1500\ cm^{-1}$$

Iz being defined as $Iz=1.9\ Fv/r\ (cm^{-1})$, in which Fv is the volume fraction of non-metallic second phases stable at temperatures below 800° C. and r is the mean radius of said precipitates, in cm;

in-line hot rolling of said strip between its solidification stage and its coiling, utilising a reduction ratio comprised between 15 and 60% at a temperature higher than 750° C.;

optionally annealing the strip after coiling;

single-stage cold rolling, or multiple stage cold rolling with intermediate annealing, with a reduction ratio comprised between 60 and 92% in at least one of the rolling passages;

primary recrystallisation continuous annealing of the cold rolled strip at a temperature comprised between 750 and 1100° C., in which the nitrogen content in the metal matrix is rised, with respect to as cast value, by at least 30 ppm at the strip core, by means of a nitriding atmosphere;

oriented secondary recrystallisation annealing at a temperature higher that the one of the primary recrystallization one.

The following Examples are intended solely for illustration purposes, not as a limitation of the invention and relevant scope.

EXAMPLE 1

A number of steel compositions were cast as strip by solidification between two counter-rotating cooled rolls, starting from alloys comprising from 2.8 to 3.5% Si, from 30 to 300 ppm S, from 30 and 100 ppm N, and different amounts of micro-alloying elements according to the following Table 1 (concentrations in ppm).

TABLE 1

| | Al | Mn | Cu | Ti | Nb | V | W | Ta | B | Zr | Cr | Bi | Sn | Sb | P | Se | Mo | Ni | Co |
|---|---|---|---|---|---|---|---|---|---|---|---|---|---|---|---|---|---|---|---|
| 1 | 300 | 1500 | — | — | — | — | — | — | — | — | 200 | — | 800 | — | — | — | 300 | 230 | — |
| 2 | 220 | 1300 | 2000 | — | — | — | 50 | — | — | — | 500 | — | — | — | 100 | — | 120 | 100 | — |
| 3 | 50 | 200 | — | — | 60 | — | — | 40 | — | — | — | | 70 | — | — | — | — | 120 | — |
| 4 | — | — | 3000 | 20 | — | — | — | — | 15 | 30 | 400 | 30 | — | — | — | 80 | 220 | — | |
| 5 | — | — | 700 | 20 | 30 | 40 | — | — | — | | 300 | — | 1000 | | — | 60 | 200 | 100 | |
| 6 | 280 | 2000 | 1000 | — | — | 40 | — | — | — | — | 1000 | — | — | — | 100 | — | 180 | 800 | 60 |
| 7 | 130 | 500 | — | 30 | — | — | — | — | — | — | — | — | 400 | 400 | 40 | 40 | — | — | — |
| 8 | 350 | 1400 | 2500 | 40 | — | — | — | — | — | — | 600 | — | 700 | — | 50 | — | — | 600 | 80 |
| 9 | 200 | 700 | 1000 | 30 | 200 | — | — | — | 15 | — | 800 | — | 600 | — | 100 | — | 100 | 220 | — |

All the strips were continuously rolled before coiling according to a defined deformation program, so that any strip contained a sequence of lengths having a decreasing thickness as a function of an increasing reduction ratio comprised between 5 and 50%. All the strips were cast with a thickness comprised between 3 and 4.5 mm and with variable casting speed, with strip temperatures at the beginning of the rolling comprised between 790 and 1120° C.

The lengths having different thickness of each strip were cut and separately coiled in small coils; each length was characterised in detail by means of electron microscopy to ascertain the second phases distribution obtained in each case, from which the mean value of the inhibition intensity Iz was calculated, in $cm^{-1}$, according to the invention.

FIG. 1 shows the characterisation results, organised according to increasing primary inhibition values measured.

The materials under test were then transformed, at laboratory scale, into finished strips 0.22 mm thick, according to the following cycle:

cold rolling to 1.9 mm thickness;

annealing at 850° C. in dry nitrogen for 1 min.;

cold rolling down to 0.22 mm;

continuous annealing comprising the steps of recrystallisation and nitriding, in sequence, respectively in damp hydrogen+nitrogen atmosphere with a $pH_2O/pH_2$ ratio of 0.58 and temperatures of 830, 850 and 870° C. for 180 s for the primary recrystallisation, and in damp hydrogen+nitrogen atmosphere with the addition of ammonia, with a $pH_2O/pH_2$ ratio of 0.15 and a $pNH_3/pH_2$ ratio of 0.2 at 830° C. for 30 s;

coating of the strips with an MgO-based annealing separator, and box-annealing in hydrogen+nitrogen, with a heating speed of 40° C./h from 700 to 1200° C., holding at 1200° C. for 20 h in hydrogen and subsequent cooling.

Specimens were obtained from each strip for a laboratory measurement of magnetic characteristics.

Figure 2:
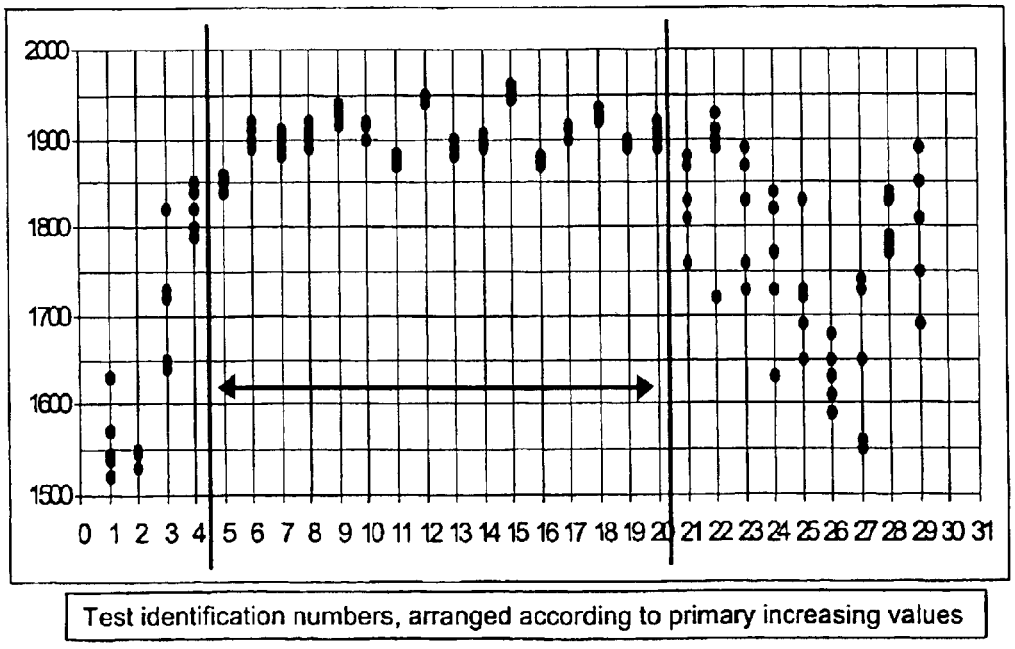
FIG. 2 shows the dispersion of said permeability measures, for each of said strips.

Outside the primary inhibition interval according to the invention, the orientation level of the finished products (FIG. 2), measured as magnetic permeability, is either too low or too instable.

EXAMPLE 2

A steel comprising: Si 3.1 wt %; C 300 ppm; $Al_{sol}$ 240 ppm; N 90 ppm; Cu 1000 ppm; B 40 ppm; P 60 ppm; Nb 60 ppm; Ti 20 ppm; Mn 700 ppm; S 220 ppm, was cast as strip, annealed at 1100° C. for 30 s, quenched in water and steam starting from 800° C., pickled, sanded and then divided into five coils. Initially, the mean thickness of strip was 3.8 mm, reduced by rolling at 2.3 mm before coiling, with a temperature, at the beginning of rolling, of 1050–1080° C. maintained throughout the strip lenght.

Each of the five coils was then cold rolled at a final thickness of around 0.30 mm according to the following scheme:

a first coil (A) was directly rolled down to 0.28 mm;

the second coil (B) was directly rolled down to 0.29 mm, with a rolling temperature at the 3°, 4° and 5° passage of about 200° C.;

the third coil (C) was cold rolled down to 1.0 mm, annealed at 900° C. for 60 s and then cold rolled down to 0.29 mm;

the fourth coil (D) was cold rolled down to 0.8 mm, annealed at 900° C. for 40 s and then cold rolled down to 0.30 mm;

the fifth coil (E) was cold rolled to 0.6 mm. Annealed at 900° C. for 30 s and then cold rolled down to 0.29 mm.

Each of the above cold rolled coils was divided into a number of shorter strips, to be treated in a continuous pilot line to simulate different primary recrystallisation annealing, nitriding and secondary recrystallisation annealing cycles. Each strip was subjected to the following scheme:

the first treatment of primary recrystallisation annealing was carried out utilising three different temperatures, i.e. 840, 860 and 880° C. in a damp hydrogen+nitrogen atmosphere with a $pH_2O/pH_2$ ratio of 0.62 and for 180 s (of which 50 s for the heating-up stage);

the second treatment of nitriding was carried out in a damp hydrogen+nitrogen atmosphere with a $pH_2O/pH_2$ ratio of 0.1, with an ammonia addition of 20%, for 50 s;

the third treatment of secondary recrystallisation was carried out at 1100° C. in a damp hydrogen+nitrogen atmosphere with a $pH_2O/pH_2$ ratio of 0.01 and for 50 s.

After coating the strips with an MgO based annealing separator, the same were box-annealed by heating-up with a gradient of about 100° C./h up to 1200° C. in a 50% hydrogen+nitrogen atmosphere, holding this temperature for 3 h in pure hydrogen, followed by a first cooling down to 800° C. in hydrogen and then to room temperature in nitrogen.

The B800 magnetic characteristics, in Tesla, measured on the strips treated as above described, are shown in Table 2.

TABLE 2

| STRIP | 840° C. | 860° C. | 880° C. |
|---|---|---|---|
| A | 1.890 | 1.920 | 1.900 |
| B | 1.890 | 1.930 | 1.950 |
| C | 1.900 | 1.900 | 1.860 |
| D | 1.890 | 1.900 | 1.840 |
| E | 1.750 | 1.630 | 1.620 |

EXAMPLE 3

The strip cold rolled according to the above defined cycle B, was treated according to a further set of treatment conditions, in which different temperatures for the precipitation of the secondary inhibition by nitriding were adopted. The strip first underwent a primary recrystallisation annealing at a temperature of 880° C., utilising the same general conditions of Example 2; then, the nitriding annealing was carried out at the temperatures of 700, 800, 900, 1000, 1100° C. Each strip was then transformed into finished product, sampled and measured, as in Example 2. The magnetic characteristics measured (B800, mT) are shown in Table 3, along with some chemical information.

TABLE 3

| Nitriding Temp. (° C.) | Total Added Nitrogen ppm* | Nitrogen Added at core** | B800 (mT) End Product |
|---|---|---|---|
| 700 | 70 | 0 | 1540 |
| 800 | 160 | 10 | 1630 |
| 900 | 270 | 70 | 1940 |
| 1000 | 230 | 100 | 1950 |
| 1100 | 200 | 95 | 1950 |

*The added nitrogen is evaluated by measuring the nitrogen in the matrix before and after the nitriding treatment.
**The measure of nitrogen diffused to the strip core is evaluated by measuring the nitrogen in the matrix after symmetrical erosion by 50% of the specimens, before and after nitriding.

EXAMPLE 4

A silicon steel was produced comprising Si 3.0 wt %; C 200 ppm; $Al_{sol}$ 265 ppm; N 40 ppm; Mn 750 ppm; Cu 2400 ppm; S 280 ppm; Nb 50 ppm; B 20 ppm; Ti 30 ppm.

A 4.6 mm thick cast strip was obtained, in-line hot rolled down to 3.4 mm, coiled at a mean temperature of about 820° C., and divided into four shorter strips. Two of said strips were double-stage cold rolled down to 0.60 mm, with an intermediate annealing on the 1 mm thick strip at 900° C. for about 120 s. The other two strips were single-stage cold rolled to the same thickness, starting from 3.0 mm. All the strips were then annealed for primary recrystallisation at 880° C. in hydrogen+nitrogen atmosphere having a dew point of 67.5° C. Then said strips were nitrided in hydrogen+nitrogen atmosphere, with the addition of 10% ammonia, having a dew point of 15° C. The strips were then coated with an MgO-based annealing separator and box-annealed with a temperature increase between 750 and 1200° C. in 35 hours in hydrogen+nitrogen atmosphere, stop at this temperature for 15 hours and cooling. The magnetic characteristics of the obtained end products are shown in Table 4.

TABLE 4

| Cold Rolling | % Last Reduction | B800 (mT) |
|---|---|---|
| Single stage 1 | 82% | 1920 |
| Single stage 2 | 82% | 1930 |
| Double stage 1 | 40% | 1560 |
| Double stage 2 | 40% | 1530 |

What is claimed is:

1. A process for the production of grain oriented electrical steel strips in which a silicon steel is continuously cast in the form of a strip 1.5 to 4.5 mm thick, hot rolled, coiled and then cold rolled to a strip 0.15 to 1 mm thick, subjected to a primary recrystallisation and decarburisation annealing and to a further annealing for secondary recrystallisation at a temperature higher than the one of said primary recrystallisation annealing, and in which a first precipitation of non-metallic second phases is promoted to inhibit grain boundaries movement with a drag force specifically comprised in the interval:

$$600\ cm^{-1} < Iz < 1500\ cm^{-1};$$

Iz being defined as Iz=1.9 Fv/r ($cm^{-1}$), in which Fv is the volume fraction of said non-metallic second phases stable at a temperature below 800° C. and r is the mean radius of said second phases;

a second precipitation of said non-metallic second phases is promoted after cold rolling, wherein said first precipitation of said non-metallic second phases is obtained though a controlled in-line deformation of the as cast strip before its coiling, utilizing a reduction ratio of between 15% and 60% at a temperature higher than 750° C.;

said hot rolled strip is cold rolled in at least one stage, with intermediate annealing, with a reduction ratio of between 60 and 92% in at least one of the rolling passages; and said second precipitation of said non-metallic second phases is obtained during said decarburisation annealing by rising the nitrogen content in the steel strip, by means of a nitriding atmosphere.

2. The Process for the production of grain oriented electrical steel strips, according to claim 1, in which the silicon steel comprises at least 30 ppm of S or N, at least an element chosen from the group consisting of Al, V, Nb, B, Mn, Mo, Cr, Ni, Co, Cu, Zr, Ta, W and at least an element chosen from the group consisting of Sn, Sb, P, Se, Bi, and in which the following group of steps is sequentially carried out:

cooling cycle of the as solidified strip comprising a step of deformation at controlled temperature utilising a reduction ratio comprised between 15% and 60% at a temperature higher than 750° C., so as to obtain in the metal matrix a homogeneous distribution of non-metallic second phases able to inhibit the grain boundaries movement with a drag force specifically comprised in the interval $$600\ cm^{-1} < Iz < 1500\ cm^{-1}$$

Iz being defined as Iz=1.9 Fv/r ($cm^{-1}$), in which Fv is the volume fraction of non-metallic second phases stable at temperatures below 800° C. and r is the mean radius of said precipitates, in cm;

single-stage cold rolling, or multiple stage cold rolling with intermediate annealing, with a reduction ratio comprised between 60 and 92% in at least one of the rolling passages;

primary recrystallisation continuous annealing of the cold rolled strip at a temperature comprised between 750 and 1100° C., in which the nitrogen content in the metal matrix is rised, with respect to as cast value, by at least 30 ppm at the strip core, by means of a nitriding atmosphere.

3. The process according to claim 1, in which the primary recrystallisation annealing is carried out in an oxidising atmosphere, to decarburise the strip and/or to carry out a controlled surface oxidation thereof.

4. The process according to claim 1, in which the strip is annealed between the steps of coiling and of cold rolling.

5. The process according to claim 1, in which the finishing cold rolling temperature is higher than 180° C. in at least two contiguous passes.

6. The process according to claim 1, in which during the primary recrystallisation annealing of the cold rolled strip a nitriding treatment of the strip is carried out in a controlled atmosphere, in which a mixture comprising at least $NH_3$+$H_2$+$H_2O$ is present, and at a temperature higher than 800° C., so that nitrogen penetration and nitrides precipitation down to the strip core is obtained, directly during the continuous annealing.

* * * * *